United States Patent [19]

Young

[11] 4,009,550

[45] Mar. 1, 1977

[54] MODULAR PILING SYSTEM

[75] Inventor: Frank Edward Young, Abingdon, England

[73] Assignee: West's Piling and Construction Company Limited, Great Britain

[22] Filed: July 17, 1975

[21] Appl. No.: 596,911

[30] Foreign Application Priority Data

Dec. 2, 1974 Canada ..... 215085

[52] U.S. Cl. ..... 52/726; 52/127; 52/722; 61/56

[51] Int. Cl.[2] ..... E04C 3/30; E02D 35/00

[58] Field of Search ..... 52/726, 731, 733, 722, 52/127; 403/294, 408, 292; 61/56; 287/130

[56] References Cited

UNITED STATES PATENTS

| | | | |
|---|---|---|---|
| 2,353,444 | 7/1944 | Conradty et al. | 403/294 |
| 3,248,888 | 5/1966 | Williams | 52/726 |
| 3,504,500 | 4/1970 | Fristeot | 52/726 |
| 3,650,553 | 3/1972 | Wennstrom | 403/294 |
| 3,838,547 | 10/1974 | Meisberger | 52/726 |
| 3,901,042 | 8/1975 | Wahman | 61/56 |

FOREIGN PATENTS OR APPLICATIONS

| | | | |
|---|---|---|---|
| 1,171,222 | 1/1959 | France | 403/294 |

*Primary Examiner*—Price C. Faw, Jr.
*Assistant Examiner*—Robert C. Farber
*Attorney, Agent, or Firm*—Kane, Dalsimer, Kane, Sullivan and Kurucz

[57] ABSTRACT

A precast modular piling system of square-sectioned reinforced concrete sections of standard interchangable lengths are capable of being connected by a joint constituted by a steel jointing piece appearing at either end of the pile sections for purposes of enabling any length of pile to be constructed. Each jointing piece includes a shaped plate secured to the end of a pile section with a framing sleeve extending laterally from each plate. A recess extends inwardly from each corner of the jointing piece through the plate, adjacent parts of the framing sleeve and concrete of the pile section. The recesses are so dimensioned and shaped to receive an end of a substantially I-shaped locking pin which serves to join a driven pile section to a driving pile section upon placement of the respective facing plates in bearing relationship with one another. The abutting surfaces of the and the facing plates are planar to optimize surface-to-surface contact between these parts. The proper location of the locking pins during pile driving and subsequent thereto is maintained by distorting the plates with a hammer or appropriate tool at the shank portion of each recess to prevent the pins from retracting. The spacing between the locking pins and reinforcement bars appearing in the concrete sections at each corner thereof are held to an absolute minimum to assure proper performance of the joint in transmitting loads and stresses during the driving operation and demands of structural support.

17 Claims, 7 Drawing Figures

MODULAR PILING SYSTEM

BACKGROUND OF THE INVENTION

The present invention constitutes an improvement over the pile joint disclosed in Svensson British Specification No. 1,393,998 published Aug. 21, 1974. The Svensson joint consists basically of a pair of square base plates with corner slots. Anchor bars fixed to the base plates are used to attach the plates to the associated reinforced concrete pile sections. Locking pins serve to couple adjoining base plates and are double headed and circular in cross-section with the center stem being coaxial with the enlarged heads. A frusto-conical portion of the head is located at its junction with the center stem. The pile joint is made by driving the pins into the aligned slots at the corners of the coupled square plates.

A joint of the Svensson type presents a number of serious drawbacks. In this connection, the slots must be formed accurately at their inner ends in order to receive the circular stem of the pin. Bearing between pin and plate is on the tapered (frusto-conical) section of the pin head and over no more than 75% of the circumference of the pin head, the remainder being over the slot. Accordingly, contact area is small and high local stresses can occur in the metal of the pin. Thus, when the pile is in tension or bending, bearing stresses will be very high and deformations correspondingly pronounced. The bearing area can be increased only by decreasing the taper and increasing head diameter or increasing the whole pin diameter. This is self-defeating as it increases pin to anchor distance. Also, use of high tensile steel is expensive and leads to possible corrosion by electrolysis. None of these approaches offer a practical solution to this problem.

In the Svensson joint, although the head of the pin approaches the anchor bar attaching the joint plate to the reinforced concrete, the pin is nevertheless spaced from the axis of the anchor bar to a relatively significant extent. The distance between the end of the pin slot and the anchor bar is critical in the performance of the joint in tension or in bending. An increase in this distance dramatically decreases performance. In this connection, in order to transfer the forces from the reinforcement in one section of a pile to the reinforcement in the section of the pile which is being joined to the first section, it is of the greatest importance that the pin be located as close to the line of the reinforcement bars as possible. With the Svensson joint it is difficult to locate the stem of the pin close to the line of the reinforcement because of the pin shape. Accordingly, the distortion factor of the plate increases because as a practical matter, the driving forces are rarely truly axial thereby generating bending moments during the driving operation. In addition, lateral forces on buildings and structures supported by the piles similarly induce bending moments which have their effect on base joint distortion problems. Thus, strength can be regained only by an increase in basic plate thickness or decrease in head diameter of the pin. However, an increase in plate thickness requires increase in pin stem length and consequently increase in deformation of the joint in tension or bending and a decrease in head diameter of the pin would further reduce the contact area and increase the stresses in the pin head. Obviously these proposals do not offer satisfactory solutions to the deformation problem. Be that as it may, the walls of the slot recess of the Svensson joint prevents the pin from being located in close alignment with the reinforcement bars.

As indicated, the Svensson pin is circular with a small taper appearing at the junction of the head with the center stem. With a pin of this type, it is extremely difficult when making a pile joint to drive home the pin because its shape promotes tilting and above all the shank cannot be struck with a hammer or other impact imposing tool. Towards this end, it is necessary to strike both the top and bottom heads simultaneously with the hammer, otherwise tilting will occur. When the pin has been partially driven home, it is necessary to strike the cylindrical stem. This tends to rotate the pin and delay the operation. In addition, hammering on the relatively slender pin, increases the risk of deformation, damage or breakage. Obviously, at the pile driving site, in outdoor conditions, it is essential for cost savings that the pin driving process be as speedy as possible. The driving home of the pin requires a blow applied uniformly over the pin length, otherwise it jams without going fully home, thereby reducing joint efficiency.

Furthermore, in order to receive the cylindrical stem of the Sevensson pin, the inner part of the corner recesses must be accurately formed. This is a relatively expensive process in the manufacture of the plate. Above all, the cost of manufacturing the entire joint is proportionately increased.

Under field conditions, pile splices often times fail directly in the joint. To develop splice systems with strengths equal to or greater than the piles themselves is usually extremely costly.

Joints have also been proposed that involve welding. However, these are relatively time consuming during fabrication involving costly down-time on the driving rig. They also carry the inherent risk of damaging the adjacent concrete as a result of heat input.

Joints requiring bolts carry the risk of bolt lossening as a result of vibration during driving. Sleeved type joints have a very poor resistance to bending as well as tensile forces. Joints utilizing mechanical locking are generally preferable, providing there is no risk of the mechanical connection being loosened.

Inherent in many of the prior art joints is the risk of damage when the section is being handled and when it is being driven. If a machined groove or face of projection is damaged, the matching component will not fit. The consequences of this are either (a) delays while difficult repairs are being carried out; (b) abandonment of piles; (c) continuation of driving while connection is imperfectly made.

SUMMARY OF THE INVENTION

An object of the present invention is to provide a precast modular piling system for fast and economic piling under the most severe driving conditions, having a resulting joint providing flexural strength equal to that of the pile.

Another object is to provide a pile designed to accept severe stresses in compression, bending and tension arising from severe driving and subsequent working loads.

A further object is to provide pile units that are fully interchangable and can be assembled to any required length because of the unique joint system.

An important attribute of the pile joint of the present invention is that it is capable of connecting two sections of pile in such a way, that no loss of pile strength occurs at the joint, and the connection between pile sections is not only capable of being made quickly, but is absolutely secure against loosening during driving.

A principal object is to eliminate the disadvantages of the aforenoted prior art pile joints and at the same time reduce the cost of joint fabrication and installation at the pile driving site.

An important object is to provide an improved construction of locking pin which can now be located in close alignment with the reinforcing bars thereby reducing to an absolute minimum the distance between the reinforcing bars of the precast concrete pile section and the locking pins in order to reduce the bending moment generated in the plate at this location during the driving of the pile and as a result of lateral forces applied in service.

A further object is to provide a locking pin that may be readily installed because it can be struck centrally without deviating in anyway while being driven to the end of the accommodating recess without danger of breakage.

A still further object is to provide a locking pin providing a relatively large contact area with the plates to ensure that the applied bending and tension loads are uniformly distributed across the full section of the locking pin.

The pile joint of the present invention is capable of being produced at a minimal cost because it may be readily manufactured using materials and fabricating equipment that is readily available.

The joint is rarely damaged during handling and the only discernable damage may be in regard to distortion of grooves. However, grooves of the present joint are readily straightened by driving a blunted chisel into the recess, an operation that requires only a few seconds.

The joint is most secure against risk of damage during driving. The perfectly flat top surface of the hardware plate cannot be damaged by the impact forces during driving and forms an ideal surface by which such impact foraces are transmitted to the full concrete section.

Further objects and advantages include the provision of a pile joint having the following attributes:

a. the hardware at each end of a pile section is identical for maximum production flexibility and avoids the necessity of turning sections end-for-end on the pile driving site;
b. the hardware at each end of the pile sections is simple and structurally sound to avoid damage when handling, lifting and dragging the sections at the site;
c. the fitting and jointing of a hoisted pile section to a driven section is simple and in addition is provided with means for aligning the two sections before completing the connection;
d. no special operator skills or tools are required for effectuating the pile joint;
e. the pile joint effectively locks the two pile sections together and does not vary from joint-to-joint nor is there a dependency on the skill or strength of the person making the connection;
f. the hardware at the end of the section to which the driving force is applied is simple and robust to prevent damage or distortion when struck and distributes the driving force to the full section of the pile;
g. the pile joint is capable of being used on reinforced or prestressed pile sections.

BRIEF DESCRIPTION OF THE DRAWINGS

Other objects and advantages will become apparent from the following detailed description which is to be taken in conjunction with the accompanying drawings in which.

DETAILED DESCRIPTION

Figure 1:
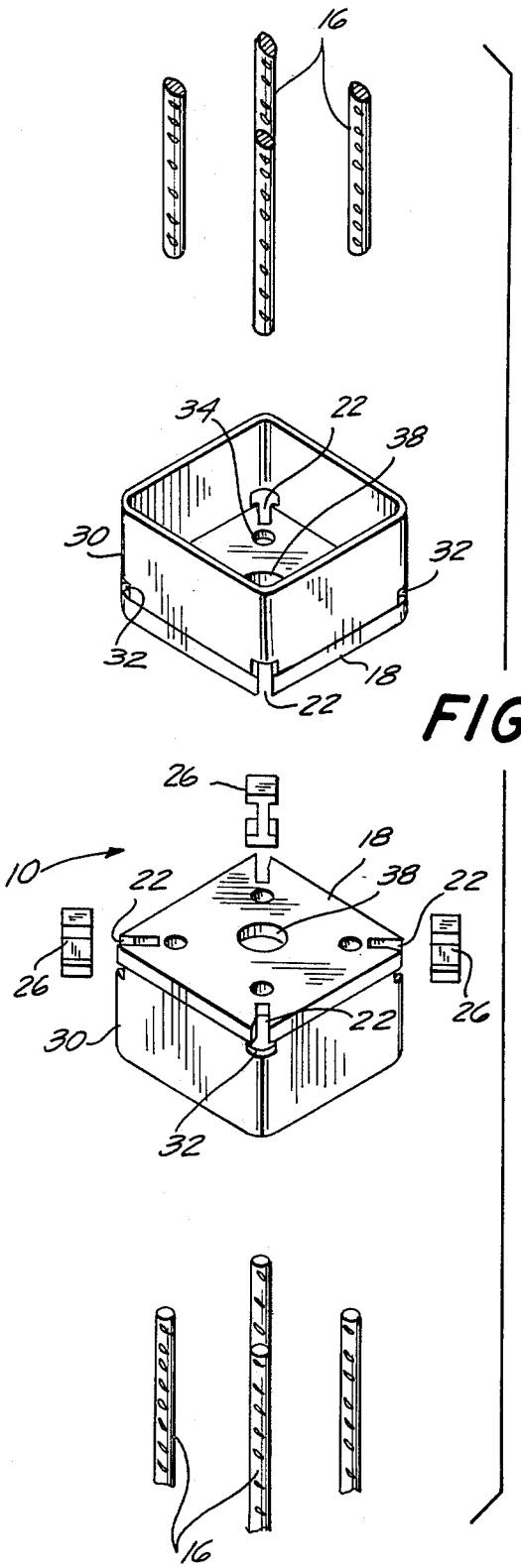
FIG. 1 is an exploded perspective view of the parts constituting the pile joint of this invention.
Figure 2:
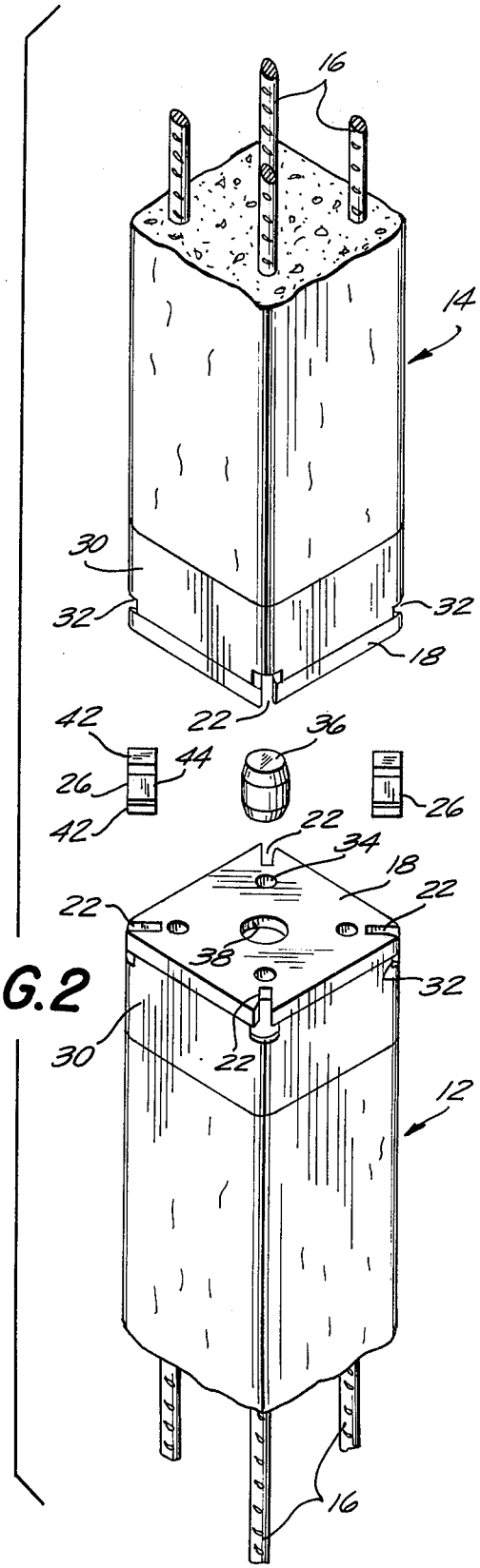
FIG. 2 is another exploded perspective view of a pair of reinforced concrete pile sections having associated joint plates at their adjacent ends for coupling to one another in an aligned fashion by means of the centering device and locking pins.
Figure 3:
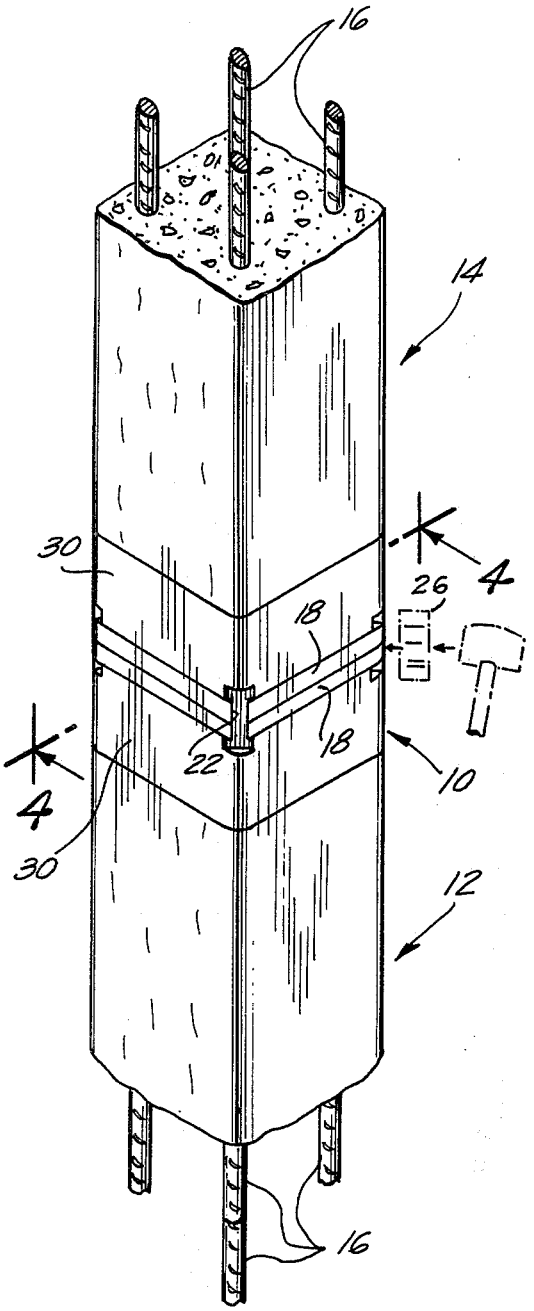
FIG. 3 is a similar perspective view showing the pile sections coupled to one another by the joint.
Figure 4:
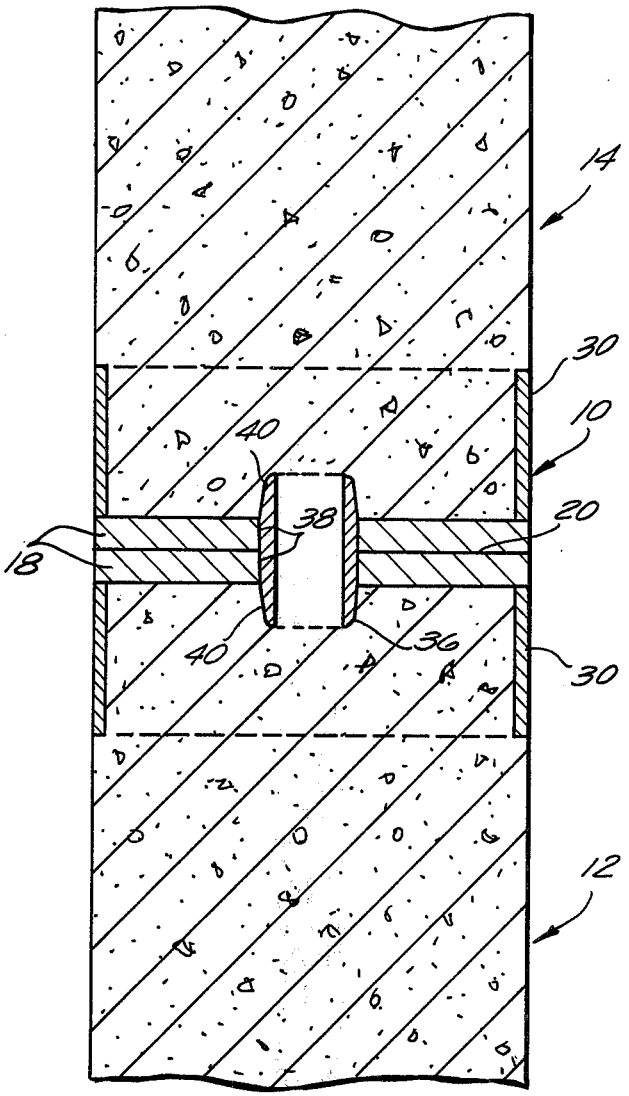
FIG. 4 is an enlarged fragmentary view taken along the line 4—4 of FIG. 3.
Figure 5:
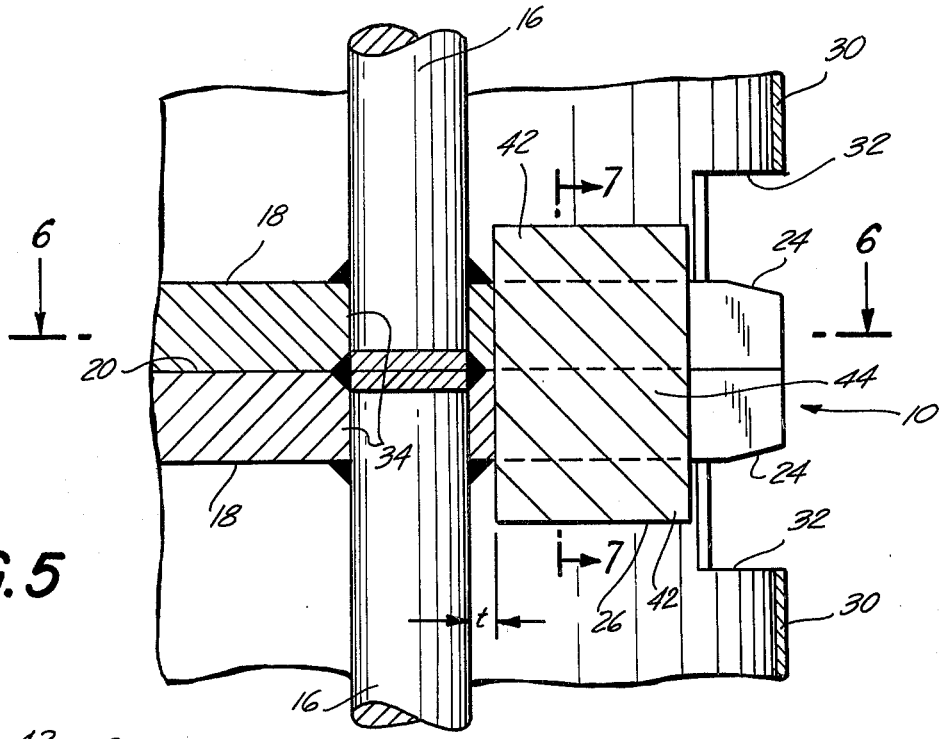
FIG. 5 is a further enlarged fragmentary sectional view showing the relationship between the locking pins and the reinforcement bars.
Figure 7:
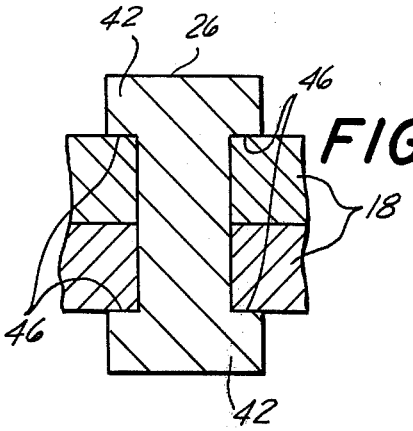
FIG. 7 is a cross-sectional view taken along the line 7—7 of FIG. 5.

The joint unit 10 incorporating the teachings of the present invention is utilized in connecting driven pile section 12 to driving pile section 14. Each pile section 12 and 14 is of preselected modular length and in the illustrated embodiment are of substantially square cross-section. Adjacent each of the corners of each section are located reinforcing or anchor bars 16. The joint unit 10 includes a pair of facing plates 18 each of which is adapted to be secured to the associated ends of a pile section. In the connecting position the plates 18 bear flatly against each other with contact between their outer planar surfaces 20. The plates 18 are formed with registering recesses 22 at each corner having chamfered edges 24 which are adapted to receive locking pins 26 of substantially I-shaped cross-section. In plan each recess 22 includes at least one outwardly flared zone 28 for facilitating the insertion of the locking pins 26. The side walls of each recess 22 are parallel along substantially the entire length thereof with the inner recess wall being at right angles thereto. A zone 28 of at least one of the side walls of each recess increasingly diverge outwardly along the outer end of each recess to aid insertion of the locking pin 26. A peripherally extending apron or sleeve 30 extends normally from each plate 18 and is secured thereto by welding. The sleeves 30 serve to reduce concrete shattering during the pile driving operation among other functions. The corner of each sleeve 30 adjacent the recess corners of the plate are also provided with companion recesses 32.

The ends of each reinforcing bar 16 are welded to or otherwise anchored to each plate and in order to facilitate this securement, they conveniently extend into accommodating recesses 34 in each plate. A coupling 36 is adapted to be inserted in the top of a pile section in order to center the other pile section. For this purpose each of the plates 18 is provided with a center hole 38 communicating with a recess 40 in the adjacent end of the concrete pile section.

Figure 6:
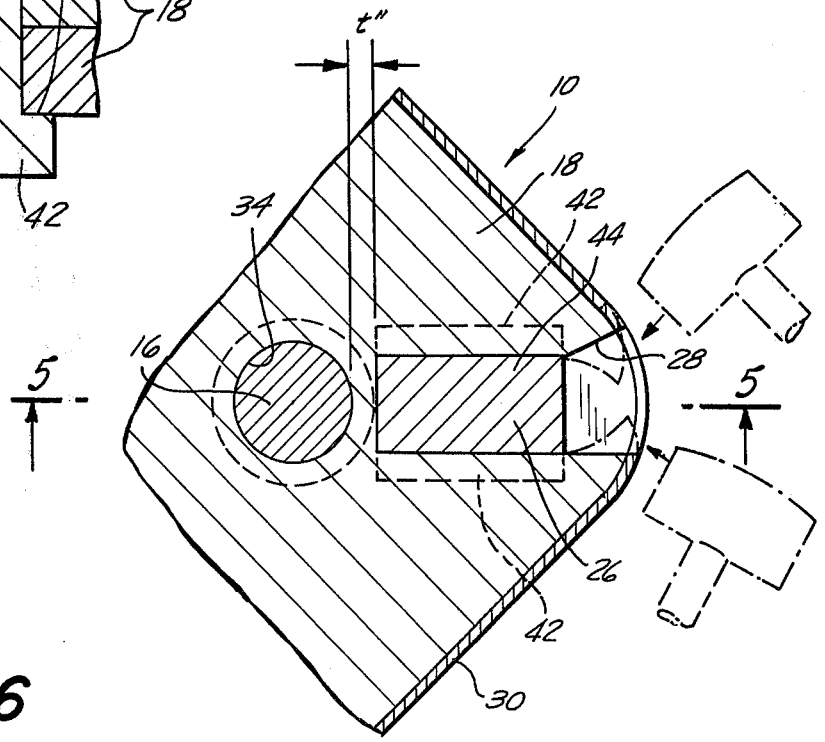
FIG. 6 is a fragmentary cross-sectional view taken along the line 6—6 of FIG. 5.

Each of the locking pins 26 is intended for tight insertion into the aligned corner recesses 22 and companion recesses 32. Towards this end, locking pin 26 includes opposed heads 42 connected by the shank 44. During the insertion process, the heads 42 are adapted to engage with the chamfered edges 24, and the shank 44 is adapted to engage with the diverging zone 28. Each pin 26 is of a length at least substantially equal to that of the portion of each recess 22 having the parallel side walls to provide a bearing area of pin to base plate over substantially the whole of the pin head as shown quite clearly in FIG. 6. In order to obtain optimum bearing area the four faces 46 of each of the pins 26 are fabricated parallel to one another. A hammer, sledge, or other appropriate tool may be employed for purposes of driving the pin home in the receptive recesses 22. In order to ensure the absolute security of the pin 26, at least one of the outer corners of each plate recess is deformed by the hammer, sledge or selected tool. Thus, in a rather simple and positive manner, retention of the pin 26 during the pile driving operation is attained and this convenient arrangement enables a visible check to be made of the security of the joint.

Since the joint relies on the cooperation between the pin heads 42 and the plates 18, the tolerances for the corner recesses 22, which are straight cut are not too critical. The facing plates 18 are constructed or ordinary mild steel and are cut to shape on a conventional profile cutter and are each drilled with four holes. The plates are preferably fabricated by a flame cutting technique. The straight line flame cutting of the plate greatly reduces the cost of plate fabrication. The bars 16 are high tensile steel and are cropped to length and then welded into the drilled holes 34 in the plate 18. The sleeve 30 is of a light gauge mild steel cut to size and punched to form corner recesses 32. The sleeve 30 is fabricated in two halves which are tack welded together and then tack welded to the plate 18. The pins 26 are shaped by milling a rectangular recess in each of a stock size of mild steel flat bar. This bar is then cut into shorter lengths for forming the pin. The coupling 36 is most economically made by die-casting aluminum alloy. Small quantities can be formed from a turned short section of steel tube.

As will be appreciated, the corners at the end of each of the pile sections are required to be recessed to cooperate with recesses 22 and 32 for purposes of accommodating the heads 42 of the pins 26. Towards this end, formers are advantageously utilized for forming the recesses in the concrete. These formers can be adapted to be used also for the purpose of aligning the joints tightly and squarely during operation of concreting the pile.

The present invention provides for increased bearing area of the pin 26 on the base plate 18 by obtaining bearing over the whole pin head 42. It is extremely important to note that the distance *t* between the pin 26 and anchor bar 16 is reduced to an absolute minimum without removing essential concrete cover. In fact, the separation between the anchor bar 16 and associated locking pin 26 is dictated only by the size of the weld that serves to aid in securing the reinforcing bar 16 to the plate 18. Thus, the almost complete alignment of the locking pin 26 relative to the adjacent anchor bar 16 serves to greatly reduce local stresses which might otherwise cause failure of either the pin head 42 or plate 18. As will be appreciated by those skilled in the art thinner base plates are possible without danger of deformation.

The structure of the joint unit 10 enables easier and simple site operation. The rectangular pin 26 is more easily fed into the receptive recesses as compared to prior art units with the rather inexpensive chamfers 24 and tapered zone 28 providing good lead-in without reducing bearing area. In this manner the pins 26 do not jam as is the case in the prior art discussed in the above, and each pin is strong against deformation because of the flat rectangular pin construction resulting in maximum bearing area.

Thus it will be apparent that a practical and economical pile coupling joint is provided by this invention with the following advantages:

a. The hardware at each end of the pile sections are the same thereby avoiding end-for-end selection on the pile driving site.
b. The hardware for the joint is designed such that only minimum damage may occur when handling on the pile driving site.
c. The recess for receiving the locking pins are held to a minimum size thereby avoiding loss of concrete sections in the vicinity of the joint.
d. The hardware of the joint may be produced at a minimum of expense.
e. The joint is provided with facilities for quick alignment of the pile sections.
f. The joint and particularly the locking pin and procedure are relatively simple, strong, durable and inexpensive.
g. The joint permits relatively quick and certain initial insertion of the locking pin in the early stage of securement.
h. A locking pin and procedure is provided which may be performed quickly and easily without special tools or skills.
i. The locking pin and associated hardware is designed in such a manner that it cannot be dislodged or loosened when the pile is being subject to stress variations and vibrations during driving and thereafter when the pile sections are called upon to support the selected super structure.
j. The detail of the locking pin recess has been designed in such a way that the former required to produce this recess may serve also the purpose of securing and aligning the joints during the operation of concreting unit.

Thus the several aforenoted objects and advantages are most effectively attained. Although a single somewhat preferred embodiment of the invention has been disclosed herein, it should be understood that this invention is in no sense limited thereby and its scope is to be determined by that of the appended claims.

What is claimed is:

1. A pile connecting device, comprising two plates each plate being adapted to be secured to the end of a pile section, each plate having several corners and having a number of recesses extending inwardly from its periphery, there being a recess formed at a selected number of the corners of each plate, each plate having two parallel planar surfaces, one of which is adapted to bear against one of the planar surfaces of the other plate when the plates are brought into abutment, a recess in one plate registering with a corresponding recess in the other plate, and a longitudinal pin substantially uniformly I-shaped in cross-section throughout its length adapted to be inserted and retained in a pair of registering recesses, each pin having opposed ends and including in cross-section a central stem and a head at each end of the stem, the heads and stem of each pin being substantially flush at each end thereof, substantially the entire underfaces of the heads of the pin bearing against the outer planar surfaces of the abutting plates, the pins being uniformly distributed around the periphery of the plates in selected pairs of registering recesses, at least one bar anchored to each plate adjacent to and spaced from each recess, each recess being so constructed and arranged that the associated pin is in relative close alignment with such bar to reduce the deformation of the plate between the bar and the adjacent recess wall and consequent joint failure, and means cooperating in securing the pin in each recess to maintain it therein during the pile driving operation.

2. A pile connecting device as claimed in claim 1, wherein the side walls of each recess are planar and parallel along substantially the whole length of the recess, the inner end wall of the recess being planar and normal thereto.

3. A pile connecting device as claimed in claim 2, wherein said pin has a length substantially equal to that of said portion of each recess having parallel side walls.

4. A pile connecting device as claimed in claim 2, wherein the outer peripheral portion of each plate surrounding each recess is chamfered to facilitate feed-in of the leading end of each pin.

5. A pile connecting device as claimed in claim 2, wherein at least one of the side walls of each recess is increasingly divergent outwardly along the outer edge portion of each recess.

6. A pile connecting device as claimed in claim 1, wherein the plates are substantially square, there being a recess formed at each corner of each plate.

7. A pile connecting device as claimed in claim 1, wherein a reinforcing bar of a pile section is anchored to each plate spaced from the end of each recess along the longitudinal axis thereof.

8. A pile connecting device as claimed in claim 1, wherein the plates are substantially square, there being a recess formed at each corner of each plate, a reinforcing bar of a pile section is anchored to each plate spaced from the end of each recess along the longitudinal axis thereof.

9. A pile connecting device as claimed in claim 8, wherein the inner end wall of each recess is as close as is physically possible to the adjacent reinforcing bar to permit the associated pin to be in relative close alignment with such bar to reduce the deflection of the plate between the bar and the adjacent inner recess end wall and consequent joint failure.

10. A pile connecting device as claimed in claim 1, wherein the pile connecting device is coupled with a pair of reinforced concrete pile sections each cast with one plate forming part of a driven pile section and the other plate forming part of a driving pile section.

11. A pile connecting device as claimed in claim 1, wherein a sleeve is connected to each plate for reducing shattering of the concrete at this end of each pile section during the pile driving operation.

12. A pile connecting device as claimed in claim 1, wherein at least one of the walls of the outer edge portion of each recess is adapted to be deformed inwardly to secure the pin in each recess.

13. A pile connecting device as claimed in claim 1, wherein indexing means are provided centrally of each plate to align a driven pile section with a driving pile section to facilitate connection thereof.

14. A pile connecting device as claimed in claim 1, wherein each I-shaped pin as defined by planar walls includes in cross-section a central stem having opposed and parallel side walls, a head at each end of the stem, each head including an outer wall and a pair of spaced wall sections separated by the adjacent end of the stem, the wall sections of each pair being parallel to one another and to the wall sections of the opposed head.

15. A pile connecting device as claimed in claim 2, wherein the recesses are formed by flame-cutting.

16. A pile connecting device as claimed in claim 1, wherein the side walls of each recess are planar and parallel along substantially the whole length of the recess, the inner end wall of the recess being planar and normal to said side walls, the plates are substantially square, there being a recess formed at each corner of each plate, the outer peripheral portion of each plate surrounding each recess is chamfered to facilitate feed-in of the leading end of each pin, the side walls of the outer edge portion of each recess being increasingly divergent, the recesses are formed by flame-cutting, the inner end wall of each recess is as close as is physically possible to the adjacent reinforcing bar to permit the associated pin to be in relative close alignment with such bar to reduce the deflection of the plate between the bar and the adjacent inner recess end wall and consequent joint failure, the walls of the outer edge portion of each recess are deformed inwardly to secure the pin in each recess, a reinforcing bar of a pile section is anchored to each plate spaced from the end of each recess along the longitudinal axis thereof, said pin has a length substantially equal to that of said portion of each recess having parallel side walls, each I-shaped pin as defined by planar walls includes in cross-section a central stem having opposed and parallel side walls, a head at each end of the stem, each head including an outer wall and a pair of spaced wall sections separated by the adjacent end of the stem, the wall section of each pair being parallel to one another and to the wall section of the opposed head, a sleeve is connected to each plate for reducing shattering of the concrete at this end of each pile section during the pile driving operation, indexing means are provided centrally of each plate to align a driven pile section with a driving pile section to facilitate connection thereof.

17. A pile connecting device as claimed in claim 16, wherein the pile connecting device is coupled with a pair of reinforced concrete pile sections each cast with one plate forming part of a driven pile section and the other plate forming part of a driving pile section.

* * * * *

UNITED STATES PATENT OFFICE

CERTIFICATE OF CORRECTION

PATENT NO. : 4,009,550

DATED : March 1, 1977

INVENTOR(S) : Frank Edward Young

It is certified that error appears in the above-identified patent and that said Letters Patent are hereby corrected as shown below:

In the abstract:

Line 17 delete "and the".

Signed and Sealed this

Seventh Day of June 1977

[SEAL]

*Attest:*

RUTH C. MASON
*Attesting Officer*

C. MARSHALL DANN
*Commissioner of Patents and Trademarks*